US006569002B2

(12) United States Patent
Smith et al.

(10) Patent No.: US 6,569,002 B2
(45) Date of Patent: May 27, 2003

(54) HAND-HELD OSCILLATING SPINDLE SANDER

(75) Inventors: John Charles Smith, Jackson, TN (US); Mark Alan Etter, Jackson, TN (US); Brent Edward Stafford, McLemoresville, TN (US); James Timothy Stolzer, Jackson, TN (US); Craig Allen Carroll, Jackson, TN (US); Thomas O'Neal Walls, Cedar Grove, TN (US)

(73) Assignee: Porter-Cable/Delta, Jackson, TN (US)

( * ) Notice: Subject to any disclaimer, the term of this patent is extended or adjusted under 35 U.S.C. 154(b) by 0 days.

(21) Appl. No.: 09/731,796

(22) Filed: Dec. 8, 2000

(65) Prior Publication Data

US 2002/0009951 A1 Jan. 24, 2002

Related U.S. Application Data

(60) Provisional application No. 60/169,991, filed on Dec. 10, 1999.

(51) Int. Cl.[7] ..... B24B 23/00

(52) U.S. Cl. ..... 451/357; 451/358; 451/449; 451/349; 451/456

(58) Field of Search ..... 451/357–358, 451/449, 349, 508–510, 456; 144/135.2, 48.6, 253.2, 253.5, 253.1, 253.9, 523, 557; 409/180–183; 16/41 R, 121, DIG. 12

(56) References Cited

U.S. PATENT DOCUMENTS

| | | | |
|---|---|---|---|
| 1,295,359 | A | 2/1919 | Olson |
| 1,662,137 | A | 3/1928 | Summers |
| 1,849,868 | A | 3/1932 | Einstein |
| 2,105,762 | A | 1/1938 | Zimmerman |

(List continued on next page.)

FOREIGN PATENT DOCUMENTS

| | | | |
|---|---|---|---|
| DE | 3805926 | A1 | 9/1989 |
| DE | 4033316 | A1 | 4/1992 |
| DE | 9315498.4 | U1 | 5/1994 |
| DE | 29508308 | U1 | 10/1995 |
| EP | 0002145 | A1 | 5/1979 |
| EP | 0631843 | A1 | 1/1995 |
| EP | 0635333 | A1 | 1/1995 |
| EP | 0872308 | A2 | 10/1998 |
| SU | 1668782 | A1 | 8/1991 |

OTHER PUBLICATIONS

"Half–Pint Sander Does Big Jobs", title of publication unknown, p. 215, Jan. 1950.

"Oscillating Spindle Sanders," Wood Magazine, pp. 62–69, Feb. 1999.

"Oscillating Spindle Sanders Under $700," Wood Magazine, Sep. 1994, 76–82.

(List continued on next page.)

*Primary Examiner*—George Nguyen
(74) *Attorney, Agent, or Firm*—Hunton & Williams

(57) ABSTRACT

A hand-held oscillating spindle sander is disclosed. The sander includes a pair of toothed pulleys associated with the output shaft. The first pulley is attached to the output shaft for rotation with the output shaft. The second pulley is rotatably disposed on the output shaft for relative rotation with respect to the output shaft. The second pulley includes opposed camming surfaces formed on the inside thereof. A cam follower is attached to and extends from the output shaft so that it is positioned between the opposed camming surfaces. A pair of belts are respectively entrained around the first and second pulleys from a jackshaft rotatably received in the housing. Upon rotation of the belts, both pulleys rotate, but at slightly different speeds. This slight difference in speeds causes the cam follower to move along the opposed camming surfaces to create an oscillation effect for the output shaft. A dust recovery system is associated with the base of the tool proximate to where the sanding tools engages the workpiece.

23 Claims, 10 Drawing Sheets

U.S. PATENT DOCUMENTS

| | | | | | |
|---|---|---|---|---|---|
| 2,252,176 | A | | 8/1941 | Harris, Jr. | |
| 2,323,433 | A | | 7/1943 | Whittaker | |
| 2,426,028 | A | | 8/1947 | Krueger | |
| 2,484,471 | A | | 10/1949 | Shinn | |
| 2,521,900 | A | | 9/1950 | Clark | |
| 2,858,701 | A | | 11/1958 | Willcox | |
| 2,979,962 | A | | 4/1961 | Nindel | |
| 3,037,328 | A | | 6/1962 | Kaveny et al. | |
| 3,120,845 | A | | 2/1964 | Horner | |
| 3,181,280 | A | | 5/1965 | Bubelis | |
| 3,312,118 | A | | 4/1967 | Aubert | |
| 3,579,915 | A | * | 5/1971 | Satterthwaite | 451/344 |
| 3,720,269 | A | | 3/1973 | Wanner et al. | |
| 3,841,416 | A | | 10/1974 | Pfister | |
| 3,855,869 | A | | 12/1974 | Dimitrov | |
| 3,886,789 | A | | 6/1975 | Brookfield | |
| 3,903,657 | A | | 9/1975 | Pfister | |
| 4,090,297 | A | | 5/1978 | Wanner et al. | |
| 4,158,313 | A | | 6/1979 | Smith | |
| 4,169,681 | A | | 10/1979 | Kato | |
| 4,308,738 | A | | 1/1982 | Yoshida | |
| 4,397,055 | A | | 8/1983 | Cuchiara | |
| 4,398,374 | A | | 8/1983 | Amann et al. | |
| 4,436,163 | A | | 3/1984 | Simpson | |
| 4,529,044 | A | | 7/1985 | Klueber et al. | |
| 4,557,303 | A | | 12/1985 | Gardner et al. | |
| 4,567,950 | A | | 2/1986 | Fushiya et al. | |
| 4,603,448 | A | | 8/1986 | Middleton et al. | |
| 4,651,474 | A | | 3/1987 | David | |
| 4,821,457 | A | | 4/1989 | Ianuzzi | |
| 4,864,775 | A | | 9/1989 | David | |
| 4,952,159 | A | * | 8/1990 | Fukuda et al. | 409/138 |
| 4,984,640 | A | | 1/1991 | Gillan et al. | |
| 5,036,925 | A | | 8/1991 | Wache | |
| 5,077,855 | A | | 1/1992 | Ambasz | |
| D345,366 | S | | 3/1994 | Hewitt | |
| D349,292 | S | | 8/1994 | Chunn | |
| 5,335,560 | A | | 8/1994 | Wang | |
| 5,347,765 | A | * | 9/1994 | Mixon | 451/442 |
| 5,402,604 | A | | 4/1995 | Hashii et al. | |
| 5,402,605 | A | | 4/1995 | Paules | |
| 5,525,099 | A | | 6/1996 | Baird et al. | |
| 5,531,636 | A | | 7/1996 | Bissen | |
| 5,549,507 | A | | 8/1996 | Schroeder et al. | |
| 5,558,566 | A | | 9/1996 | Hashii et al. | |
| 5,564,971 | A | * | 10/1996 | Evensen | 451/504 |
| 5,607,265 | A | | 3/1997 | Lane | |
| 5,624,302 | A | | 4/1997 | Hashii et al. | |
| 5,649,852 | A | | 7/1997 | Zepp | |
| 5,676,497 | A | | 10/1997 | Kim | |
| 5,678,292 | A | | 10/1997 | Kimbel et al. | |
| 5,716,263 | A | * | 2/1998 | Jones et al. | 451/344 |
| 5,833,524 | A | * | 11/1998 | Satoh et al. | 451/456 |
| 5,842,913 | A | | 12/1998 | Nemazi | |
| 5,860,852 | A | | 1/1999 | Hashii et al. | |
| 5,916,014 | A | | 6/1999 | Schroeder et al. | |
| 5,957,765 | A | | 9/1999 | Kimbel et al. | |
| RE37,486 | E | * | 12/2001 | Stanzione | 451/523 |

OTHER PUBLICATIONS

"Bench Oscillating Spindle Sander (Model 31–780) Instruction Manual," Delta International Machinery Corp., Sep. 28, 1995, 1–11.

Maas, Bernie, "Oscillating Spindle Sanders," Fine Woodworking, Jul./Aug. 1999, 52–53.

"Clayton Oscillating Spindle Sanders," Innovative Shop Solutions 1998 Catalog, 25.

* cited by examiner

HAND-HELD OSCILLATING SPINDLE SANDER

This application claims benefit of Provisional Application No. 60/169,991 filed on Dec. 10, 1999.

BACKGROUND OF THE INVENTION

1. Field of the Invention

This invention relates to the field of hand-held power tools, and more specifically to a hand-held power tool suitable for sanding or rasping applications.

2. Description of the Prior Art

Woodworking as a hobby has become quite popular. Tools which were once marketed only to professional woodworkers are now conveniently available to woodworkers of all skills, from beginners to seasoned hobbyists and professionals. Hand-held power tools come in a number of different varieties suitable for professional and hobbyist applications. For instance, woodworkers are quite familiar with hand-held power tools such as drills, circular saws, plate joiners, sanders, routers, planers, etc. But due to design constraints, certain tools have been limited to bench top applications. One of these is the oscillating spindle sander.

An oscillating spindle sander is a tool which, as its name implies, may be used to sand a workpiece. A spindle typically protrudes from the bench top. The spindle is operatively connected to a motor which, through a series of belts, pulleys, gears or other transmission devices, causes the spindle to rotate. A drum is typically secured to the spindle. Sandpaper or other roughened material is applied to the drum. The rotating drum, along with the sandpaper, is brought into contact with the workpiece for sanding or removing material from the edge of the workpiece. The spindle is also caused to reciprocate in an axial direction. Otherwise, the same segment of the sandpaper would be repeatedly applied to the workpiece. This would cause premature wearing of the sandpaper, as well as the generation of excessive heat and burning of the workpiece.

To date, no commercial hand-held oscillating spindle sanders are available on the market. Instead, all of the oscillating spindle sanders are of the bench top variety. Among other reasons, one of the challenges facing a designer of a hand-held oscillating spindle sander is developing a light-weight, compact design which permits hand-held operation. Until now, no such tool had been designed to satisfy these competing criteria. Solutions have been proposed. None have been commercially viable on a large scale.

For example, U.S. Pat. Nos. 5,678,292 and 5,957,765 to Kimbel et al. disclose a hand-held machine tool which may be used for sanding a workpiece. Oscillation of the sanding tool is provided by one of several proposed oscillation devices, ranging from a swash plate to a driving disk associated with a rotating gear which is adapted to engage a disk follower member on the output shaft. In all but one of these embodiments, the drive shaft is perpendicular to the output shaft. Bevel gears are therefore needed to turn the direction of rotational power from perpendicular to parallel with respect to the drive shaft. This leads to a decrease in power efficiency compared to the configuration where the drive shaft and output shaft are parallel with one another.

Using a swash plate to create the oscillation of the output shaft unnecessarily complicates the tool. The swash plate is attached at an angle to a so-called intermediate shaft. As a consequence, the swash plate and the intermediate shaft are spaced from and parallel to the output shaft. A grooved roller is operatively coupled to the output shaft and engages the swash plate. As the swash plate rotates, the grooved roller is pulled up and down in a direction corresponding to the axis of the output shaft. This causes the output shaft to oscillate.

In an alternative embodiment where the swash plate is integrated into the output shaft, the grooved roller is replaced with a pin member which slides along the surface of the swash plate. This undesirable configuration could lead to the premature wearing of either the swash plate, the pin, or both. Further, this configuration would inevitably be relatively noisy in operation since the pin slides, rather than rolls, along the surface of the swash plate.

In all of the embodiments, the swash plate is relatively thin. The swash plate is cantilevered on the intermediate shaft. In operation of the tool, the swash plate would be subjected to significant forces resulting from the reciprocation of the grooved roller or pin member contacting the swash plate. Consequently, the swash plate arrangement is not the most effective mechanism for creating the oscillation motion of the output shaft.

The sander of the foregoing patents suffers from several other drawbacks. It does not have variable speed operation. Different wood stock has different surface hardness. Without a variable speed capability, the sander could damage softer wood or take longer to sand harder wood. Also, the sander of the foregoing patents does not include an edge guide assembly for precision sanding of straight surfaces. It also does not provide for means to attach the sander to the underside of a work table for conversion to a bench top oscillating spindle sander.

For these and other reasons, tools such as that disclosed in the foregoing patents have not been commercialized on a large scale. Professional woodworkers and hobbyists thus have been limited to bench top oscillating spindle sander applications. But, bench top applications limit the ability of the woodworker to truly enjoy the benefits of the oscillating spindle sander. With a bench top oscillating spindle sander, the workpiece must be moved relative to the sander during the sanding operation rather than moving the sander relative to the workpiece. Consequently, the oscillating spindle sanders of the bench top variety cannot be used to sand a workpiece which is not movable due to its size, weight, or installation constraints. For example, a bench top oscillating spindle sander cannot easily be used to sand solid surface sink cutouts on installed countertops, or the finished edges of an installed hardwood stair tread. Further, the oscillating spindle sanders of the bench top variety require a fair amount of dedicated shop space.

These and other disadvantages of the oscillating spindle sanders of the prior art are overcome by the invention of the preferred embodiments.

SUMMARY OF THE INVENTION

It is an object of the preferred embodiments to provide a portable, hand-held oscillating spindle sander.

It is a further object of the preferred embodiments to provide an oscillating spindle sander which has an integral dust collection system.

It is a further object of the preferred embodiments to provide an oscillating spindle sander in which the power transmission, including the oscillation, is achieved by a unique combination of elements which provide a compact construction.

It is a further object of the preferred embodiments to provide an oscillating spindle sander including a removable and adjustable edge guide assembly.

It is a further object of the preferred embodiments to provide an oscillating spindle sander having variable speed operation.

It is a further object of the preferred embodiments to provide an oscillating spindle sander which has internal support structures configured for easy assembly.

It is a further object of the preferred embodiments to provide an oscillating spindle sander which has adequate means for cooling the internal moving components of the sander.

It is a further object of the preferred embodiments to provide an oscillating spindle sander which has a thumb rest formed on the base for allowing a user to rest a thumb on the base while sanding.

It is a further object of the preferred embodiments to provide an oscillating spindle sander which has means for mounting the sander to the underside of a work table for conversion to a bench top oscillating spindle sander.

It is a further object of the preferred embodiments to provide an oscillating spindle sander which has a favorable ratio of oscillation to rotation of the sanding spindle.

These and other features, objects and advantages are achieved by a portable, hand-held oscillating spindle sander comprising a housing, a base associated with the housing for contacting the workpiece, a motor at least partially contained within the housing, an output shaft extending from the housing and adapted to drive a sanding tool. The output shaft is operatively coupled to the motor through a transmission so that the rotational power of the motor is transmitted to the output shaft. An oscillation device is associated with the output shaft comprising first and second camming surfaces associated with the output shaft for relative rotation with respect to the output shaft. A cam follower is operatively coupled to the output shaft for rotation with the output shaft, the cam follower engaging the first and second camming surfaces so that upon rotation of the output shaft, the cam follower moves along the camming surface to cause the output shaft to have an oscillatory translational component of movement.

The portable, hand-held oscillating spindle sander of the preferred embodiments advantageously incorporates a dust collection mechanism. Namely, the dust collection mechanism is integrated with the base assembly. The base assembly is formed with an opening through which the output shaft protrudes. A toroidal cavity extends around the opening. A plurality of vacuum ports communicate with the opening. The vacuum created within the toroidal cavity causes the dust created during sanding to be sucked within the toroidal cavity. From there, the dust is disposed through a hose, which is adapted to be attached to the front of the base.

The portable, hand-held oscillating spindle sander according to the preferred embodiments advantageously is provided with a variable speed mechanism. Namely, a variable speed dial switch permits the tool to be operated between a minimum of about 2400 rpm to a maximum of about 3600 rpm. This variability in the speed of the tool advantageously permits the shopsmith to adjust for the characteristics of the workpiece to be sanded.

The portable, hand-held oscillating spindle sander of the preferred embodiments is further advantageously constructed with internal component supporting structures. This provides ease in assembly. Namely, other than the outer, clam-shell casing, the entire supporting apparatus for the working components for the oscillating spindle sander are provided by two opposed structures, an internal support structure and a bearing housing. The internal support structure includes a plurality of annular recesses adapted to receive the bearings on which the rotating shafts are mounted. At their other ends, the rotating shafts are received in bearings mounted in annular recesses in the bearing housing. The internal support structure and the bearing housing are conveniently attached to one another after the motor, transmission means, and oscillation means are positioned for assembly. Consequently, the operational parts of the oscillating spindle sander are conveniently manufactured as an integrated unit.

The portable, hand-held oscillating spindle sander further includes an edge guide assembly. The edge guide assembly is adapted to be attached to the bottom of the base. The edge guide assembly preferably includes an adjustable infeed and an adjustable outfeed. Namely, the infeed and outfeed of the edge guide may slide along a rail formed on respective sides of the edge guide body. The adjustable edge guides assist the shopsmith in removing the precise amount of stock from the workpiece.

The portable, hand-held oscillating spindle sander further includes a thumb rest formed on the base for allowing a user to place a thumb of one hand on the thumb rest of the base and using the other fingers of that hand to feel the workpiece and determine if the sander is flat against the workpiece.

The portable, hand-held oscillating spindle sander further includes means for mounting the sander to the underside of a work table for converting the hand-held sander into a bench top sander.

The portable, hand-held oscillating spindle sander further includes a cooling fan and vents for directing cooling air around the internal moving components of the sander for cooling purposes.

The portable, hand-held oscillating spindle sander further includes a transmission that permits the output shaft to oscillate at a favorable ratio to its rotational speed.

The portable, hand-held oscillating spindle sander further includes increased friction means on the sanding spindle to prevent relative rotation between the sanding spindle and a sanding sleeve mounted on the sanding spindle.

Further objects, features and advantages of the oscillating spindle sander according to the preferred embodiments will become evident when the detailed description of the preferred embodiments is read in conjunction with the drawing figures appended hereto.

DETAILED DESCRIPTION OF THE PREFERRED EMBODIMENTS

Figure 1:
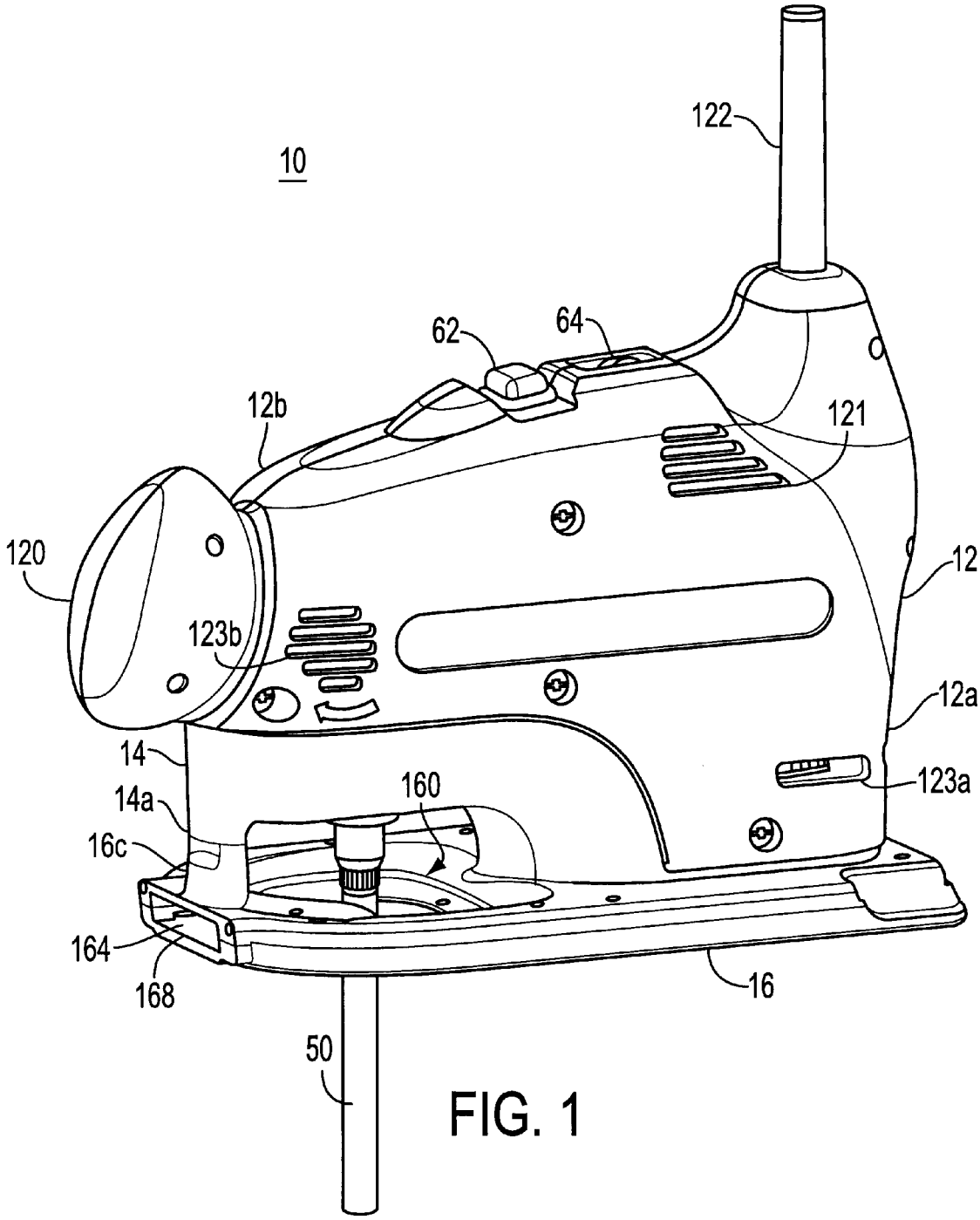
FIG. 1 is an isometric view of the oscillating spindle sander according to the preferred embodiments.

The following preferred embodiments are illustrative only. Various alternative configurations are possible within the purview of the preferred embodiments. Modifications to the preferred embodiments will be readily apparent to those skilled in the art without departing from the spirit and scope of the invention. For convenience, similar elements are designated throughout the drawing figures with the same reference numerals.

With reference to FIG. 1, the oscillating spindle sander 10 of the preferred embodiments includes a two-piece, clam shell housing 12 made from two housing halves 12*a*, 12*b*, a bearing support member or bearing housing 14 disposed beneath the upper housing 12, and a base assembly 16 attached to bearing housing 14. A handle 120 is formed with the upper housing 12. A cord-set assembly 122 is associated with housing 12. A power cord (not illustrated) is threaded through cord-set assembly 122 to energize an electric motor 202 (FIG. 3).

Figure 2:
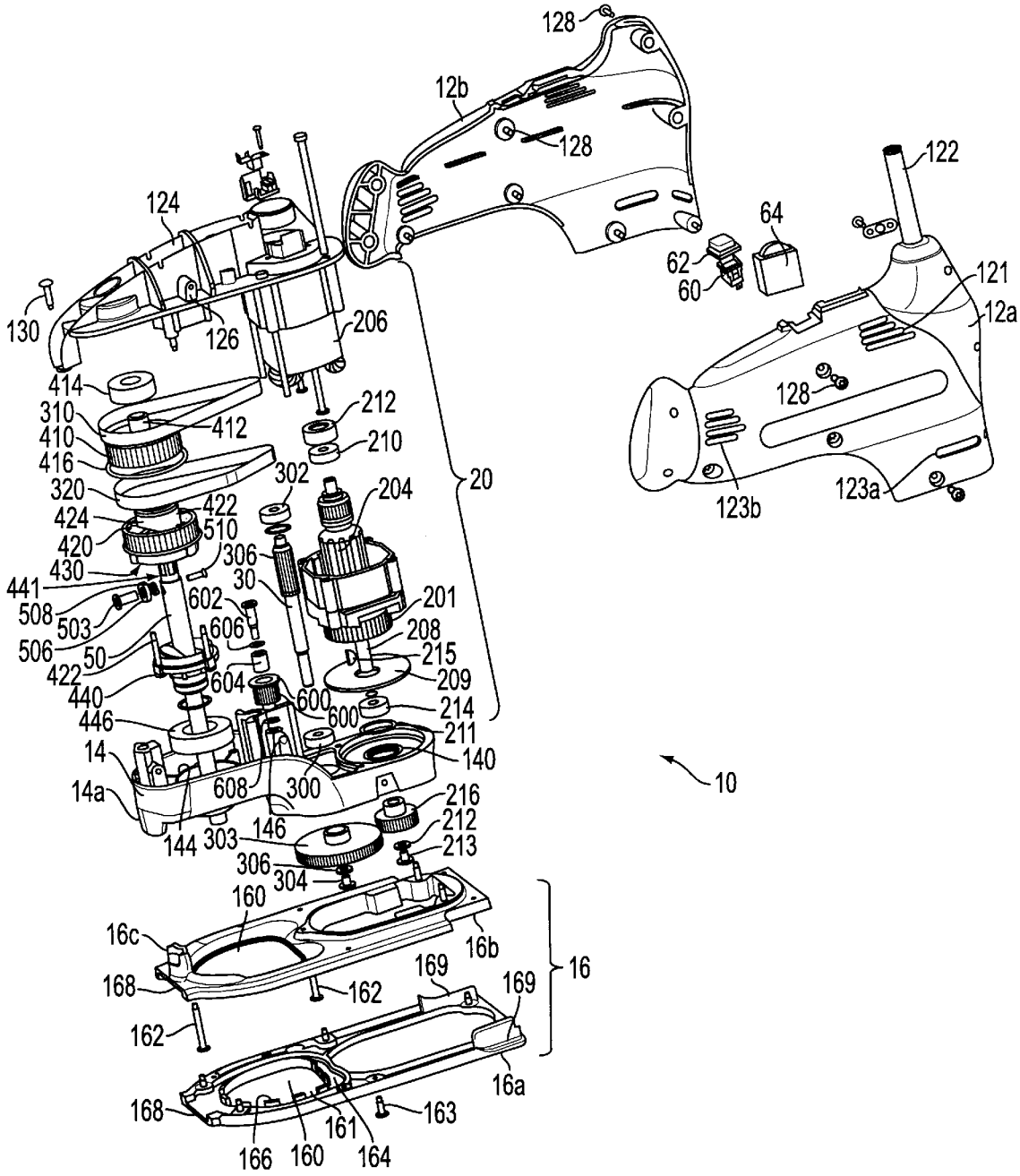
FIG. 2 is a exploded view of the oscillating spindle sander of FIG. 1.
Figure 3:
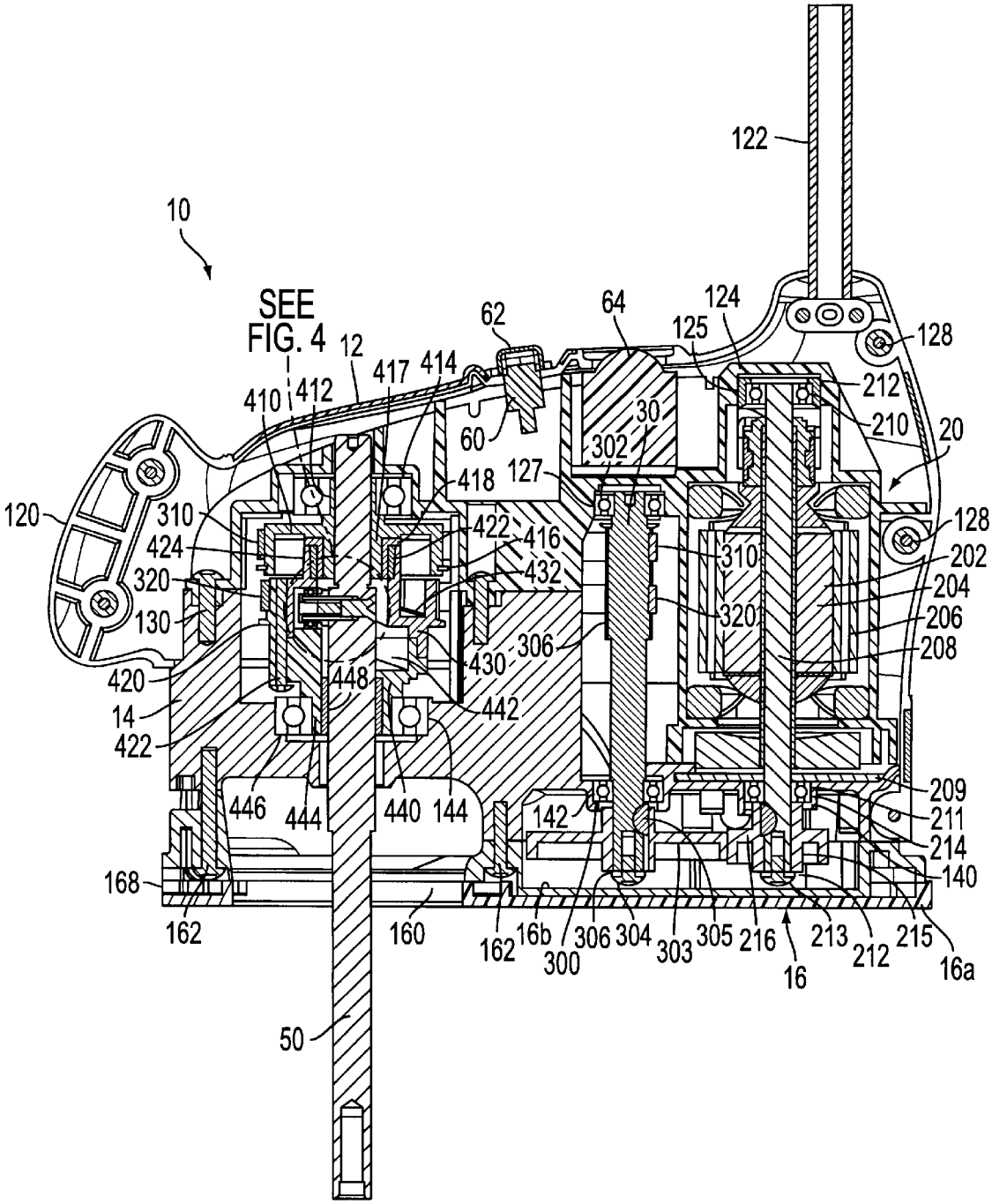
FIG. 3 is a cross sectional view of the center of the oscillating spindle sander of FIG. 1 taken along its longitudinal axis.
Figure 7:
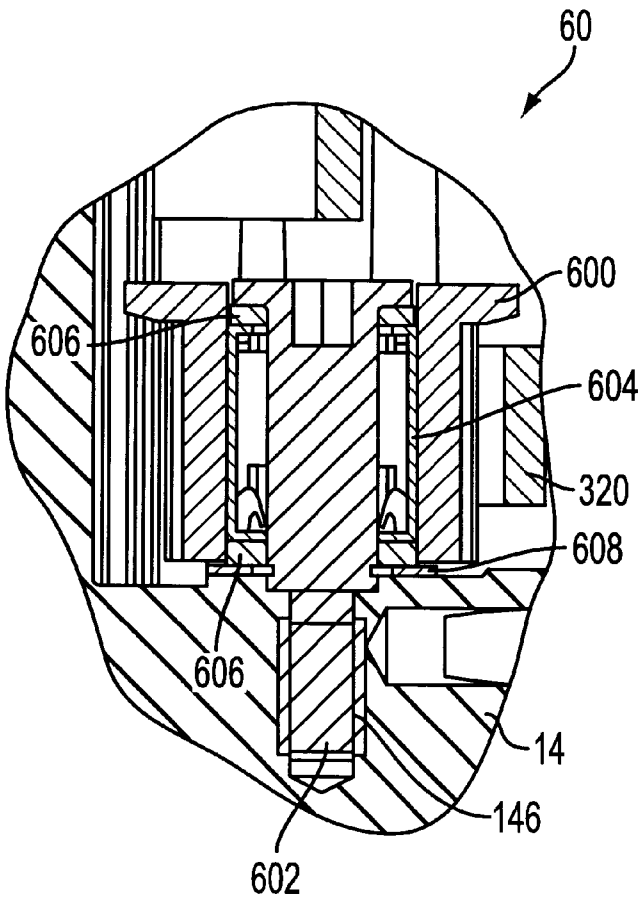
FIG. 7 is detail view of the idler mechanism taken from FIG. 6.

Now with reference to FIGS. 2 and 3 in conjunction with FIG. 1, the internal structural and supporting components of the hand-held oscillating spindle sander 10 become apparent. First, an internal support member 124 is contained within upper housing 12. Internal support member 124 is preferably made from molded plastic and includes one or more holes 126. Screws 128 are received in holes 126 and may be used to secure housing halves 12*a*, 12*b* to internal support member 124. Internal support member 124 is secured to bearing housing 14 by screws 130.

Next, base assembly 16 includes lower and upper halves 16*a*, 16*b* with an opening 160 through which an output shaft 50 protrudes. Upper half 16*b* is secured to bearing housing 14 with screws 162. Lower half 16*a* is then secured to upper half 16*b* with screws 163. As shown in FIG. 1, base assembly 16 is supported on the sander at two separate regions. Upper half 16*b* is supported by bearing housing 14 at a large region located behind the opening 160, and at another separate region, smaller than the first, located on the opposite side of opening 160. The smaller region of support is achieved through an attachment of a base support 16*c* to a bearing housing support 14*a*. The two separate support regions add to the rigidity of base assembly 16.

A dust collection system is formed in base assembly 16. Lower half 16*a* includes integrally formed walls which, when lower half 16*a* is joined to upper half 16*b*, form a hollow, toroidal-shaped vacuum chamber 164 around opening 160. Protrusions 166 extending upwardly from the lower half 16*a* of base 16 adjacent opening 160 form vacuum ports 161 around opening 160. Vacuum ports 161 draw into the vacuum chamber air which is entrained with dust generated from sanding. The vacuum ports 161 need not extend all the way around opening 160, as shown in FIG. 2.

A generally rectangular vacuum exhaust 168 is formed in the front of vacuum chamber 164. The vacuum exhaust 168 is adapted to receive a hose (not illustrated). Dust collected in the vacuum chamber 164 is directed to vacuum exhaust 168 and into the hose for disposal.

A pair of thumb rests 169 (FIG. 2) are conveniently formed in base 16. As will be readily appreciated by those skilled in the art, in operation of the sander 10, a user may grasp the handle 120 with one hand and grasp around the housing in the vicinity of the cordset 122 with the other hand. Alternatively, if desired, the user can use a first hand to grasp the handle 120 and the thumb of a second hand will rest in thumb rest 169. Some of the other fingers of the second hand will slide along the surface of the workpiece during operation. Some users prefer this second holding position because it provides a greater tactile feel for whether the sander is flat against the workpiece.

Now, having described the principal internal structural support members, the internal working members of the oscillating spindle sander may be described. For convenience of description only, there are two principal internal components, namely, the motor assembly and the transmission assembly. The transmission assembly further includes an oscillation mechanism. Each assembly will be taken up in turn below.

With continued reference to FIGS. 2 and 3, the motor assembly 20 includes an electric motor 202 (FIG. 3), which has an armature 204, a field winding 206, and a fan 201. The motor assembly 20 provides power to drive the output shaft 50. The motor assembly 20 is energized by a power cord (not illustrated) extending through cordset assembly 122. At one end, a drive shaft 208 is rotatably supported by bearing 210. Bearing 210 is received in a bearing mount 212. The bearing mount 212 is supported in an annular boss 125 formed in internal support member 124. At its other end, drive shaft 208 is rotatably supported by bearing 214, which is received in an annular boss 140 formed in bearing housing 14. A bearing retainer 209 engages the bearing 214 and, along with expandable O-ring 211, secures bearing 214 in annular boss 140. Drive shaft 208 is coupled to and rotates with armature 204.

The transmission assembly transmits power from the motor assembly 20 to the output shaft 50. The transmission assembly includes an oscillation mechanism. The transmission assembly drives the output shaft in its two components of motion: its rotational component of motion, and its oscillatory translational component of motion. The oscillation mechanism is responsible for the latter component of movement. The transmission assembly may take many forms. The transmission assembly of the preferred embodiments, which will now be described, is particularly suited for this application.

A driving gear 216 is attached to the drive shaft 208 with a screw 213 and washer 212 assembly. Driving gear 216 is attached for rotation to the drive shaft 208 by virtue of a woodruff key connection 215, but any other suitable device for coupling the driving gear 216 to the drive shaft 208 would be suitable.

Power from the driving gear 216 is transferred to the output shaft 50 through a jackshaft shaft 30. Jackshaft 30 is spaced from and mounted substantially parallel to the drive shaft 208. At its lower end, the jackshaft 30 is rotatably supported in the housing at one end by bearing 300 received in annular boss 142 formed in bearing housing 14. At its upper end, jackshaft 30 is rotatably supported by bearing 302 which is disposed in an annular boss 127 formed in internal support member 124. A driven gear 303 is secured to the terminal end of jackshaft 30 by a screw 304 and washer 306. Driven gear 303 is keyed to jackshaft 30 by a woodruff key 305, but any other device for attaching the driven gear 302 to the jackshaft 30 is suitable.

The jackshaft 30 includes a plurality of teeth 306 formed thereon at its end opposite driven gear 303. Teeth 306 are adapted to engage a pair of toothed belts 310, 320, which transmit the power of the jackshaft 30 to a pair of pulleys 410, 420 associated with the oscillation mechanism 40. The belts are preferably reinforced with Kevlar or some other resilient reinforcing material.

The oscillation mechanism is responsible for causing the oscillatory translational movement of the output shaft 50. The oscillation mechanism may take different forms. The oscillation mechanism 40 of the preferred embodiment is particularly suited to this application. The oscillation mechanism 40 is generally associated with the output shaft 50 and includes first and second toothed pulleys 410, 420. A sanding spindle, or output shaft 50 is spaced from and disposed in the housing in a generally parallel and spaced relationship with respect to the jackshaft 30. An upper or first pulley 410 may be attached to the output shaft 50 so that the rotational power imparted to the first pulley 410 by the first belt 310 is transferred to the output shaft 50. First pulley 410 may be attached to the output shaft 50 by splines 441 (FIG. 2), dog and keys or any other suitable device for transmitting rotational force to a shaft but permitting the shaft to move axially with respect to the positive driving connection. First pulley 410 has a boss 412 extending from the top thereof. Boss 412 is rotatably supported in internal support member 124 by bearings 414. A retaining ring 416 is provided on the toothed surface of first pulley 410. Retaining ring 416 prevents first belt 310 from sliding off first pulley 410. A sleeve bearing 418 surrounds the base 417 of the first pulley 410. The outer surface of sleeve bearing 418 contacts a brass bushing 422, which may be molded into the base 424 of second pulley 420.

Second pulley 420 comprises an upper cam 430 and a lower cam 440, both secured to one another by screws 422. The upper cam 430 includes an upper camming surface 432, and the lower cam 440 includes a lower camming surface 442. The camming surfaces 432, 442 are opposed to one another and form a surface between which a cam follower 500 (FIG. 4) rolls to generate the oscillation motion of the output shaft 50. The lower cam 440 includes a boss 444 (FIG. 3) extending from the end thereof. The boss 444 is rotatably received in a bearing 446, which in turn is received in an annular recess 144 formed in bearing housing 14. A brass bushing 448 is molded into the boss 444 of lower cam 440 and surrounds and abuts output shaft 50 to provide a bearing surface against which the output shaft 50 may rotate relative to the second pulley 420.

Figure 4:
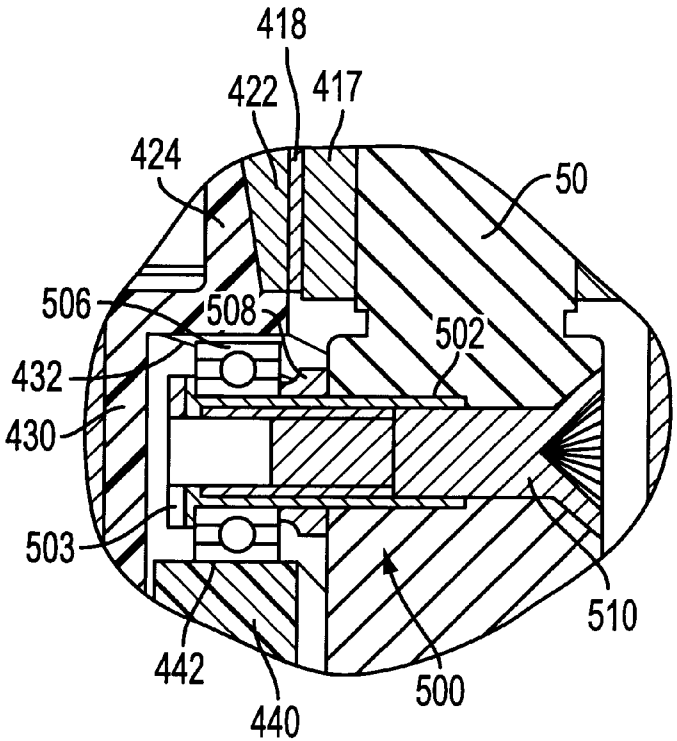
FIG. 4 is a detail view of the oscillation mechanism taken from FIG. 3.
Figure 5:
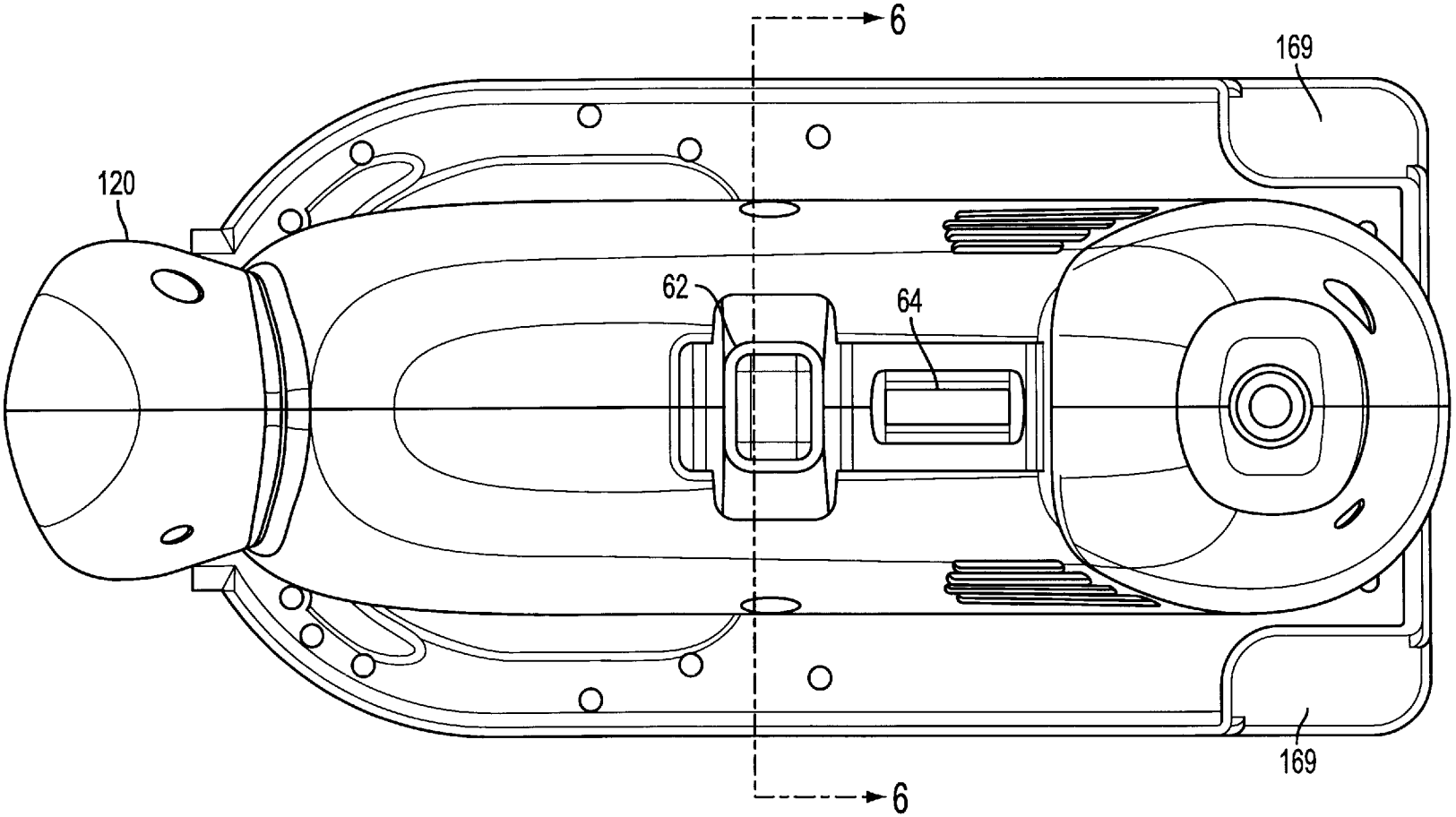
FIG. 5 is a top view of the oscillating spindle sander of FIG. 1.
Figure 6:
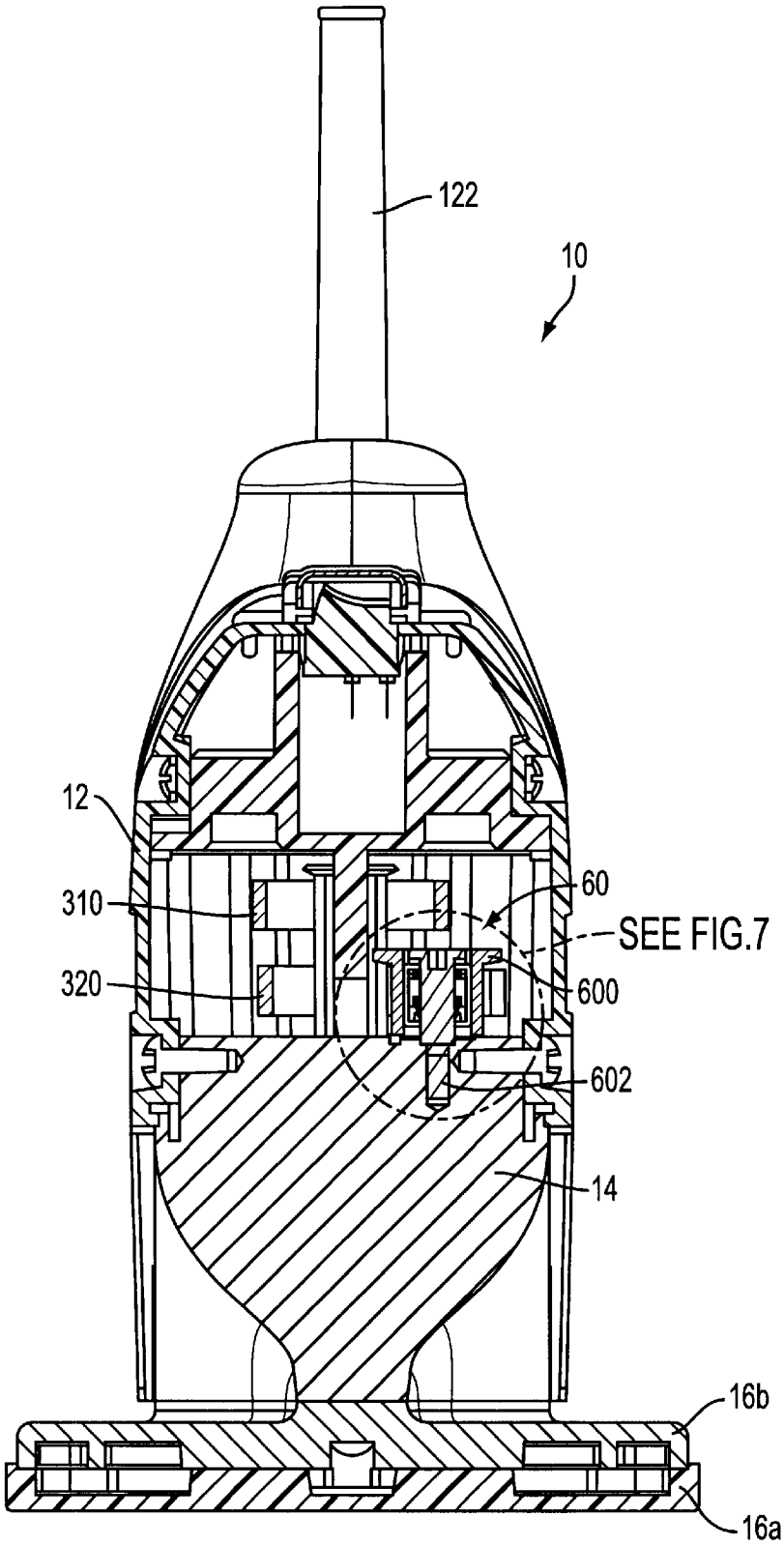
FIG. 6 is cross sectional view taken along line 6—6 in FIG. 5.

Referring to FIG. 4 in conjunction with FIGS. 2 and 3, a cam follower 500 is attached to the output shaft 50. Namely, the output shaft has a hole 502 drilled therethrough. A shouldered bearing sleeve 503 is fitted into the hole 502 and secured to the output shaft 50. A bearing 506 is disposed on the portion of sleeve 503 extending beyond the output shaft 50. A spacer 508 spaces the bearing 506 from the output shaft 50. A flat head screw 510 engages one end of the shoulder bearing sleeve 503 to secure the cam follower 500 to the output shaft 50. As upper pulley 410 rotates, it causes the output shaft 50 to rotate. As a consequence, the shouldered bearing sleeve 503 rotates, along with the bearing 506. However, due to the difference in the number of teeth on the first and second pulleys 410, 420, the second pulley 420 rotates at a speed different than the first pulley 410. This difference in rotation manifests itself by causing the bearing 506 to roll along the opposed camming surfaces 432,442 of the second pulley 420. Consequently, as the bearing 506 rolls along the opposed camming surfaces 432,442, the output shaft 50 is caused to rise and fall according to the amplitude of the opposed camming surfaces 432,442.

Since the first pulley 410 has a slightly greater number of teeth than the second pulley 420, it must be correspondingly slightly larger. It is also possible for the second pulley 420 to have a slightly greater number of teeth than the first pulley 410. Both pulleys 410, 420 have axes of rotation spaced an equal distance from the axis of rotation of jackshaft 30. Therefore, either the upper toothed belt 310 must be correspondingly larger than the lower toothed belt 320, or the toothed belts 310, 320 may be the same size and the additional slack in the lower toothed belt 320 must be taken up within the housing. Either alternative is possible within the scope of the invention. The preferred embodiments illustrate the latter alternative. Namely, with particular reference to FIGS. 2 and 5–7, an idler gear assembly 60 engages the lower toothed belt 320. The idler gear assembly 60 comprises an idler gear 600 which has an axle 602 fixedly received within a boss 146 in bearing housing 14. A needle bearing 604 and thrust washers 606 are provided so that idler gear 600 rotates with minimum resistance on axle 602. A retaining ring 608 is provided as a seat against which thrust washer 606 bears to retain axle 602 within bearing housing 14.

The small difference in the number of teeth on the first pulley 410 and second pulley 420 creates a ratio of rotation to oscillation of the output shaft 50. Namely, the output shaft 50 will complete a fixed number of complete revolutions about its rotational axis for each oscillation (up and down). In the preferred embodiment, the output shaft completes approximately sixty revolutions for each oscillation. This is important for several reasons. First, if the speed of oscillation is too great, it will cause excessive vibration of the tool. Second, if the speed of oscillation is too great, it may cause scratch marks on a wood workpiece because the sanding would occur at too much of an angle to the grain on the edge of the wood workpiece. A ratio above 35:1 is preferred, above 45:1 is even more preferred, and between 55:1 and 65:1 is the most preferred.

With particular reference again to FIGS. 1–3, the oscillating spindle sander 10 according to the preferred embodiments includes an on/off switch 60. A dust cover 62 maybe provided to prevent the fouling of the on/off switch 60. Advantageously, the oscillating spindle sander 10 of the preferred embodiments is also preferably provided with a variable speed adjustment mechanism 64. Variable speed adjustment mechanism 64 is preferably a rotary dial switch, which is designed to adjust the speed of rotation of the output shaft. In the preferred embodiment, the speed is adjustable between a minimum of about 2400 rpm to a maximum of about 3600 rpm. Variable speed adjustment mechanism 64 may be of the infinitely variable type such that an infinite number of rotational speeds are available between the minimum and maximum speeds. Variable speed adjustment mechanism 64 may be an infinitely adjustable rheostat, or another mechanism for controlling the speed of motor 202. Alternatively, a means for varying the gear ratio between the motor and the output shaft could be used. Having the ability to adjust the speed of the output shaft is advantageous as the speed and aggressiveness of the sanding tool may be adjusted to suit the particular application. For example, on some workpieces, the lowest speed may cause the work to be performed too slowly, while for other workpieces, the fastest speed may cause burning.

Figure 9:
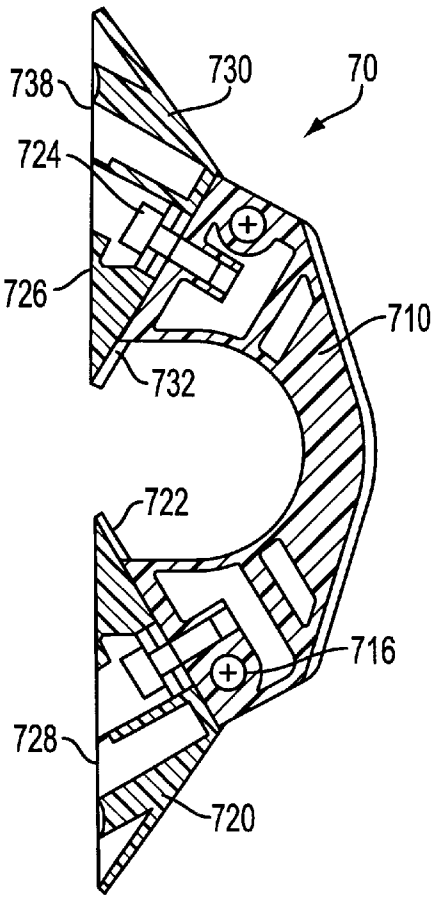
FIG. 9 is a cross section of the edge guide assembly of FIG. 8.
Figure 8:
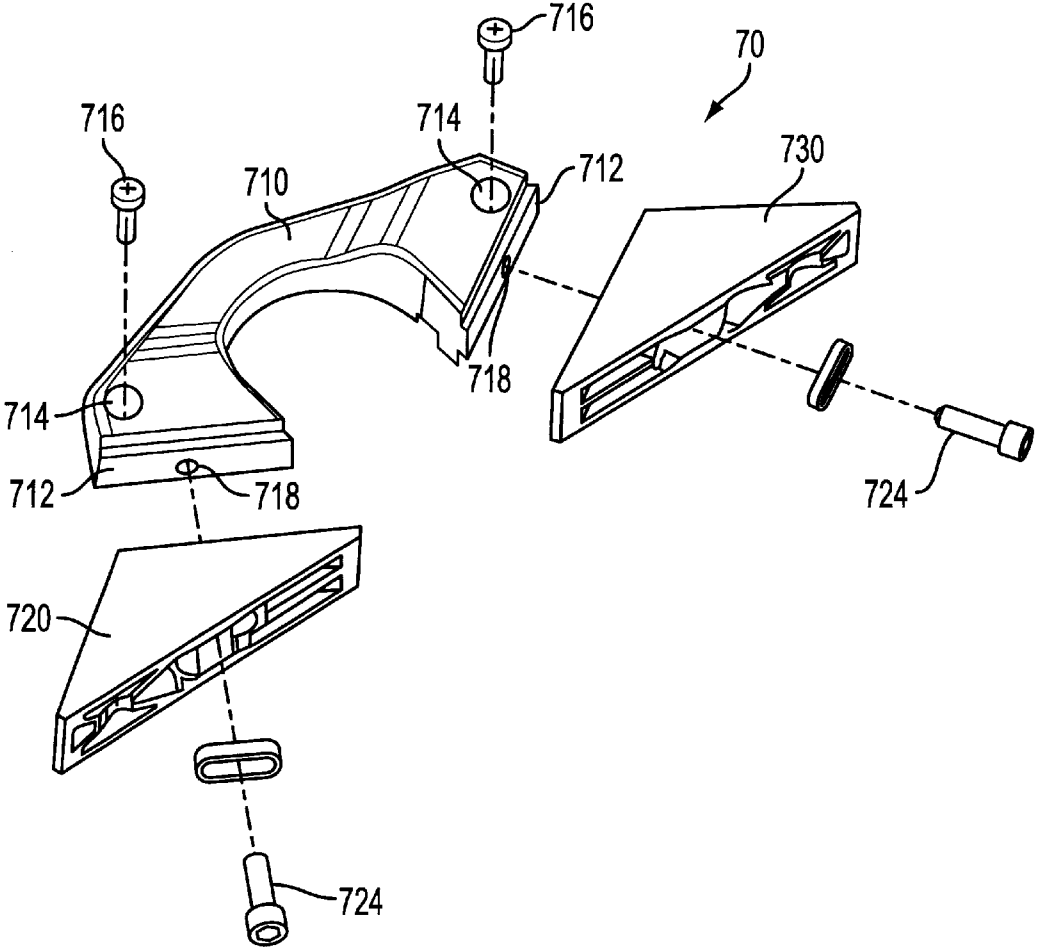
FIG. 8 is an exploded view of the edge guide assembly for use with the hand-held oscillating spindle sander of FIG. 1 according to the preferred embodiments.

Referring now to FIGS. 8 and 9, the edge guide assembly 70 according to the preferred embodiments is illustrated. The edge guide assembly 70 comprises three principle component parts, edge guide body 710, adjustable infeed 730 and adjustable outfeed 720. The edge guide body 710 is generally U-shaped and includes shoulders or tenons 712 associated with respective ends of the "U". A pair of holes 714 are formed entirely through edge guide body 710. Screws 716 are adapted to be received in holes 714. Screws 716 are received in holes formed in base assembly 16. A second pair of holes 718 are formed through shoulders 712. Screws 724 are received in holes 718 to secure infeed 730 and outfeed 720 to edge guide body 710.

The infeed 730 and outfeed 720 include corresponding recesses or mortises 722, 732 for engaging shoulders or tenons 712 associated with edge guide body 710. As seen in FIG. 9, the recesses 722, 732 are longer than the shoulders 718. This permits infeed 730 and outfeed 720 to be adjusted by loosening screws 724.

As will be seen in FIG. 9, adjustable infeed 730 is ever so slightly positioned forward of adjustable outfeed 720. This configuration desirably allows the shopsmith to control with precision the amount of stock to be removed from the workpiece. In other words, the degree of offset between the front face 738 of the adjustable infeed 730 and the front face 728 of the adjustable outfeed 720 may be selectively varied by loosening screws 724 and selectively sliding infeed and outfeed along the shoulder 712 formed on the edge guide body 710.

With several moving parts enclosed inside of the housing 12, it is important that provision is made for cooling these moving parts. In the preferred embodiment, fan 201 is positioned to draw air into the housing 12 through first vents 121 formed in housing 12. Fan 201 is positioned to draw all of this air past motor 202. A portion of the air is then vented out of the housing through second vents 123*a*. The remainder of the air is then passed through housing 12 around the transmission mechanism and is vented out of the housing through vents 123*b*. Internal support member 124 is shaped to divide the interior of housing 12 into two chambers joined around fan 201. This prevents any air that passes through the fan 201 from recirculating through the fan or from venting out through first vents 121.

Figure 10A:
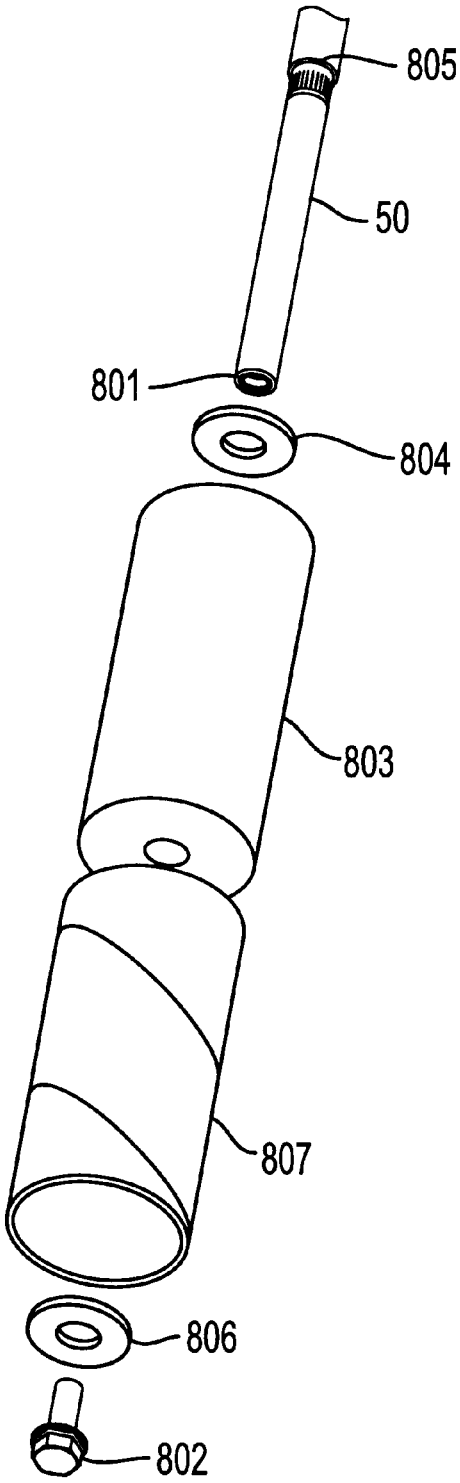
FIGS. 10A and 10B are exploded views of the sanding spindle of the oscillating spindle sander of FIG. 1 together with various sanding tools.
Figure 10B:
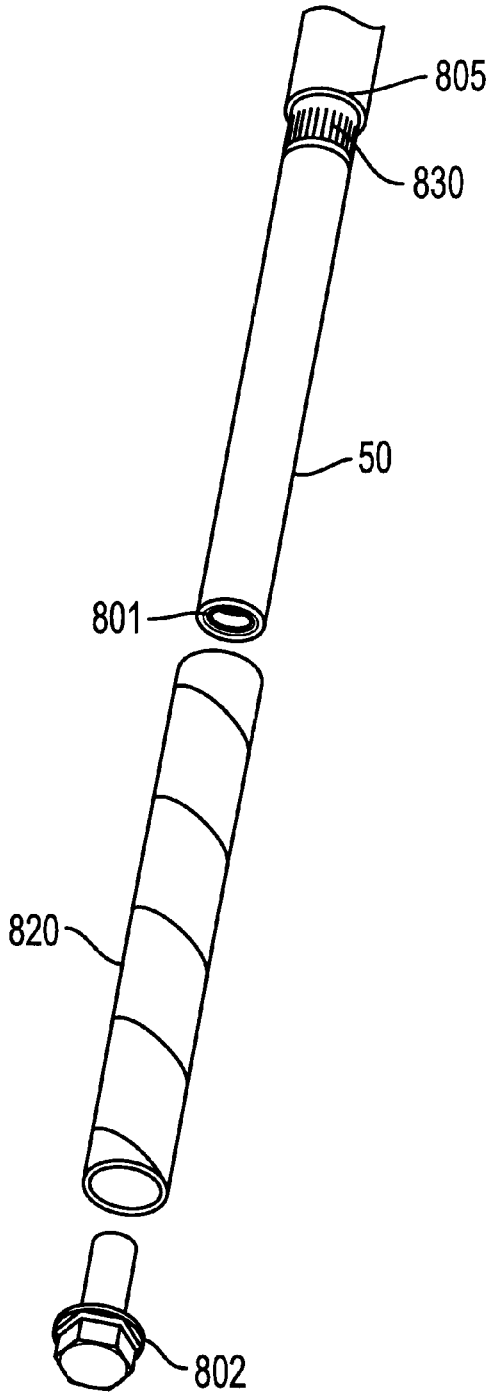

With reference to FIGS. 10A and 10B, the sanding spindle 50 includes attachment means at one end thereof for attaching a sanding tool. A sanding tool can be a sanding sleeve (a rigid sandpaper product formed into a sleeve shape), a resilient sanding drum with a sanding sleeve mounted around the drum, a rasping tool such as that described in U.S. Pat. No. 5,957,765 (Kimbel et al.), or any other tool known in the art and adapted for mounting on a spindle and performing an abrading, scraping, rasping or similar action. The attachment means of the preferred embodiment includes a threaded hole 801 formed on the end face of the sanding spindle 50 and a screw 802 adapted to be received therein. The attachment means could also include a threaded portion on the sanding spindle 50 and a nut adapted to be received thereon. When a resilient sanding drum 803 is to be attached to the sanding spindle 50, as in FIG. 10A, a washer 804 is first slid onto the sanding spindle 50 until it abuts shoulder 805. The resilient sanding drum 803 is next slid onto sanding spindle 50 until it abuts the washer 804 and another washer 806 abuts the opposite end of the resilient sanding drum 803. Screw 802 is threaded into hole 801 and secures washers 804, 806 and resilient sanding drum 803 on the sanding spindle 50. A sanding sleeve 807 is slid over the resilient sanding drum 803. When screw 802 is tightened, the resilient sanding drum 803 is slightly compressed in its axial direction. This compression causes a slight expansion in its radial direction which locks together the resilient sanding drum 803 and the sanding sleeve 807.

A small, ½" diameter sanding sleeve 820 may also be mounted on the sanding spindle 50. The small sanding sleeve 820 is mounted without resilient sanding drum 803 or washers 804, 806 —it is slid directly over the sanding spindle 50. When the screw 802 is threaded into hole 801, the small sanding sleeve 820 is prevented from sliding off. When the screw 802 is tightened, the small sanding sleeve 820 is slightly compressed and the friction generated between the small sanding sleeve 820 and the screw 802 and shoulder 805 causes the small sanding sleeve 820 to rotate with the sanding spindle 50 during operation. However, with prior sanding spindles, the friction was not sufficient in some cases and small sanding sleeve 820 slipped and rotated relative to sanding spindle 50. This relative rotation also tended to cause screw 802 to rotate relative to sanding spindle 50 and to further tighten and compress the small sanding sleeve 820. Eventually, the small sanding sleeve 820 would split apart. To avoid this, an area of increased friction 830 has been provided on the sanding spindle. The area of increased friction 830 in the preferred embodiment is knurled to raise the surface of the knurled portion above the rest of the surface of the sanding spindle. The area of increased friction 830 still allows the small sanding sleeve 820 to slide over it when the small sanding sleeve 820 is mounted on the sanding spindle 50. It generates increased frictional force during operation to help hold the small sanding sleeve 820 stationary relative to the sanding spindle 50 and prevent over-tightening of screw 802 resulting in the splitting apart of the small sanding sleeve 820.

Figure 11:
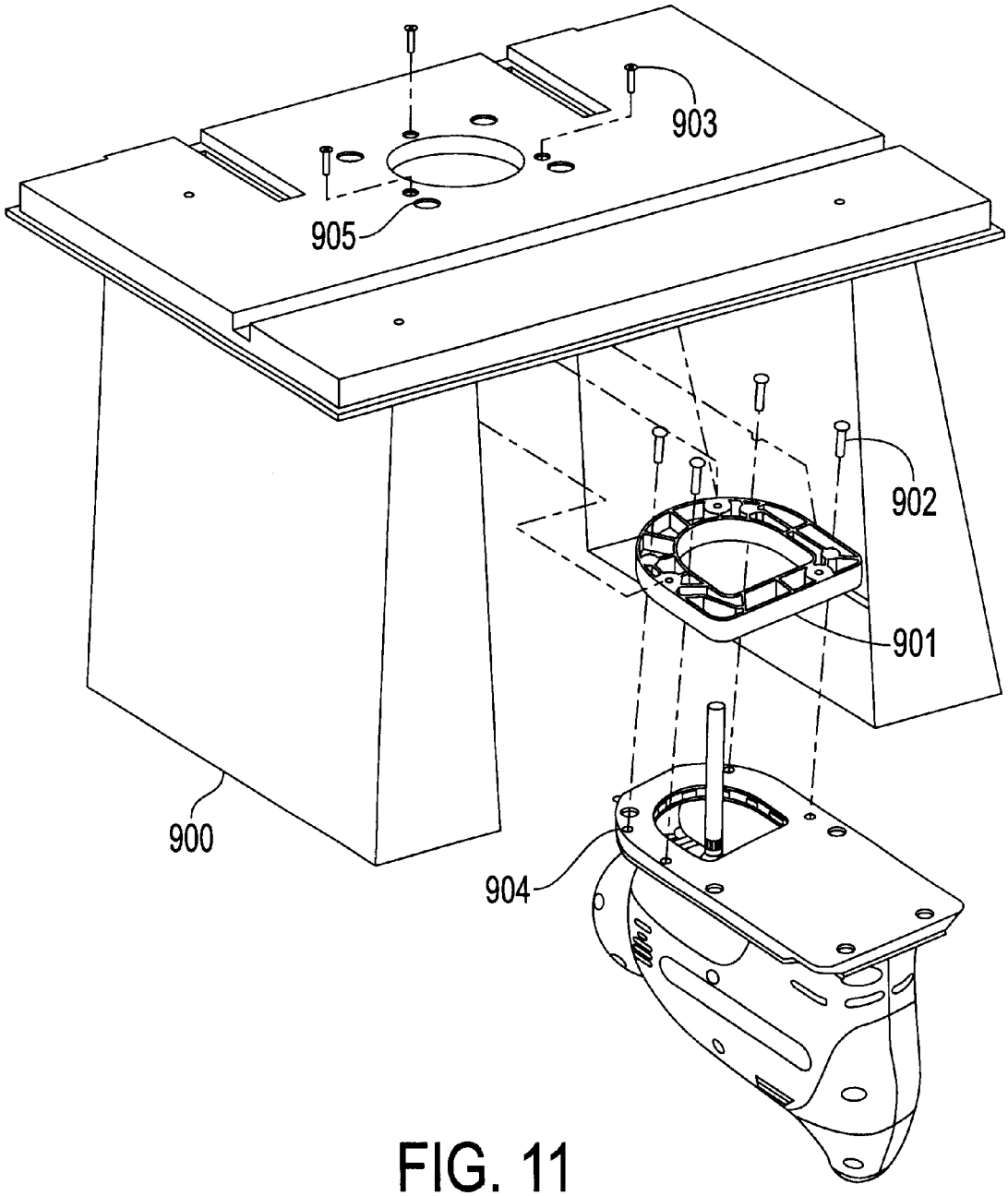
FIG. 11 is an exploded view of the hand-held oscillating spindle sander of FIG. 1 together with a work table for a conversion to a bench top oscillating spindle sander.
Figure 12:
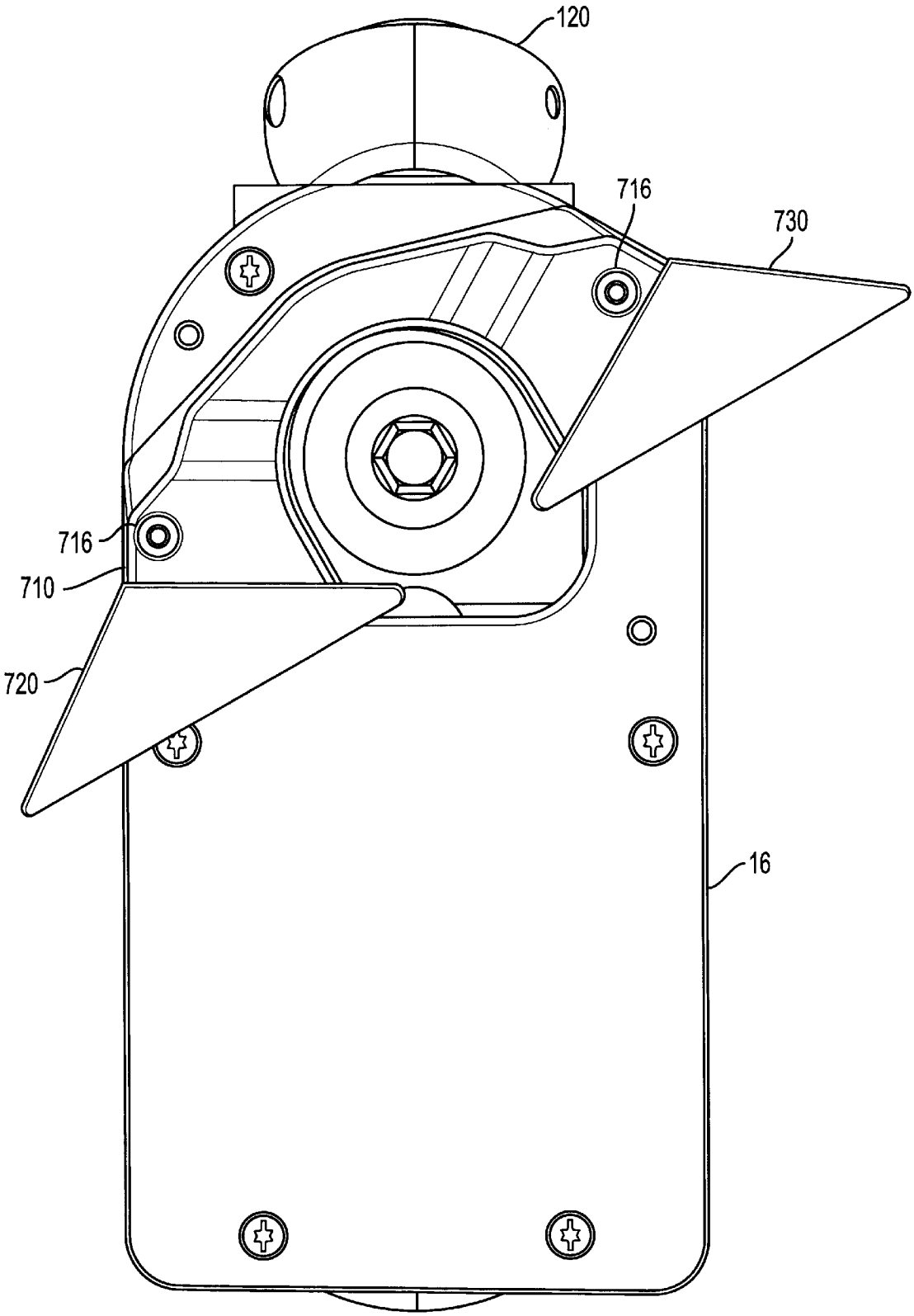
FIG. 12 is a bottom view of the hand-held oscillating spindle sander of FIG. 1 with the edge guide assembly of FIGS. 8 and 9 mounted thereon.

With reference to FIG. 11, the hand-held oscillating spindle sander 10 of the preferred embodiment includes means for mounting the sander to the underside of a work table 900 to convert the hand-held oscillating spindle sander into a bench-top oscillating spindle sander. The means for mounting of the preferred embodiment includes an adapter plate 901 and first 902 and second 903 fasteners. The base includes apertures 904 for the first 902 fasteners to fasten the oscillating spindle sander tightly to the adapter plate. Apertures 905 in the work table 900 allow the second fasteners 903 to tightly fasten the adapter plate 901, with the oscillating spindle sander 10, to the underside of the work table 900. The means could also simply include fasteners to directly fasten the oscillating spindle sander to the underside of work table 900. Also, the means could include clamps attached to the underside of work table 900 which clamp the base tightly against the underside of the table. To sand a workpiece in this configuration, the workpiece is placed on top of the work table and an edge of the workpiece is moved against a sanding tool mounted to the sander to sand the edge. This configuration may be preferable for sanding small workpieces.

Although the invention has been described in connection with the preferred embodiments, the foregoing embodiments are intended to be illustrative only. Many modifications may be made to the basic construction of the hand-held oscillating spindle sander disclosed herein without departing from the spirit and scope of the invention as defined by the claims. The invention described above is not limited to the configurations illustrated in the drawing figures. Instead, reference should be made to the claims which describe the invention and which encompass all equivalents of the preferred embodiments.

We claim:

1. A portable, hand-held oscillating spindle sander for sanding a workpiece comprising:

a housing;

a base associated with the housing for contacting the workpiece;

a motor at least partially contained within the housing;

an output shaft extending from the housing and adapted to drive a sanding tool, the output shaft being operatively coupled to the motor through a transmission so that the rotational power of the motor is transmitted to the output shaft; and an oscillation device associated with the output shaft comprising:

first and second camming surfaces associated with the output shaft for relative rotation with respect to the output shaft; and a cam follower operatively coupled to the output shaft for rotation with the output shaft, the cam follower engaging the first and second camming surfaces so that upon rotation of the output shaft, the cam follower moves along the camming surface to cause the output shaft to have an oscillatory translational component of movement.

2. The oscillating spindle sander of claim 1, wherein the transmission comprises:

a drive shaft driven by the motor;

a driving gear operatively attached to the drive shaft;

a jackshaft rotatably disposed within the housing and spaced from the drive shaft;

a driven gear operatively attached to the jackshaft, the driving gear and the driven gear being operatively engaged with one another;

a first pulley operatively mounted on the output shaft for rotation with the output shaft;

a second pulley operatively associated with the first and second camming surfaces;

a first belt extending between the jackshaft and the first pulley;

a second belt extending between the jackshaft and the second pulley;

wherein upon rotation of the drive shaft, the jackshaft is caused to rotate by virtue of the engagement between the driving gear and the driven gear, and the first and second pulleys rotate by virtue of the first and second belts extending between the jackshaft and the first and second pulleys.

3. The oscillating spindle sander of claim 2, wherein the drive shaft, the jackshaft and the output shaft are rotatably disposed in the housing in parallel with one another.

4. The oscillating spindle sander of claim 2, wherein the jackshaft has a plurality of teeth formed thereon and the first and second belts are both toothed belts which mesh with the teeth of the jackshaft.

5. The oscillating spindle sander according to claim 4, wherein the first pulley and the second pulley each have a predetermined number of teeth formed thereon, and the number of teeth on the first pulley differs from the number of teeth on the second pulley, and wherein the first and second pulleys rotate at different speeds by virtue of the different number of teeth associated therewith.

6. The oscillating spindle sander according to claim 5, further comprising an idler gear rotatably disposed in the housing between the output shaft and the jackshaft, wherein the idler gear engages the belt entrained around the pulley with the least number of teeth to compensate for the difference in teeth between the first and second pulleys.

7. The oscillating spindle sander according to claim 1, wherein the first and second camming surfaces are in opposed facing relation to one another, and the first and second camming surfaces are operatively connected to each other for rotation in unison.

8. The oscillating spindle sander according to claim 7, wherein the cam follower comprises a stub shaft attached to the output shaft and a ball bearing attached to a portion of the stub shaft, the ball bearing being positioned between the first camming surface and the second camming surface.

9. The oscillating spindle sander according to claim 8, wherein the transmission comprises:

a jackshaft rotatably disposed in the housing in spaced parallel relation with respect to the output shaft;

a first pulley operatively mounted on the output shaft for rotation with the output shaft;

a second pulley operatively associated with the first and second camming surfaces; and first and second belts extending between the jackshaft and the first and second pulleys respectively, wherein upon rotation of the jackshaft, the first and second pulleys rotate at different speeds from one another, causing the ball bearing of the cam follower to roll between the first and second camming surfaces.

10. The oscillating spindle sander according to claim 1, further comprising dust collection means associated with the housing; the dust collection means comprising a vacuum chamber proximate the output shaft and having a plurality of dust collection ports directed towards the output shaft.

11. The oscillating spindle sander according to claim 10, wherein the dust collection means is formed within the base and encircles the output shaft.

12. The oscillating spindle sander according to claim 1, further comprising an edge guide assembly adapted to be attached to the base.

13. The oscillating spindle sander according to claim 12, wherein the edge guide assembly comprises:

an edge guide frame; and a pair of wear fences adapted to attached to the edge guide frame, the wear fences being adjustable along the edge guide frame to allow for variable depth of sanding.

14. The oscillating spindle sander according to claim 1, further comprising means for varying the rotational speed of the output shaft.

15. The oscillating spindle sander according to claim 1, further comprising means for infinitely varying the rotational speed of the output shaft within a preselected range.

16. The oscillating spindle sander according to claim 15, wherein the means for varying comprises a rheostat operatively connected between a power cord and the motor.

17. A portable, hand-held oscillating spindle sander for sanding a workpiece comprising:

a base for contacting a workpiece;

an output shaft extending away from the base and capable of mounting a sanding tool, the output shaft having two components of movement relative to the base consisting of:

a rotation about the longitudinal axis of the output shaft; and an oscillatory translation in a direction parallel to the longitudinal axis of the output shaft;

a motor operatively connected and driving the output shaft;

a transmission interconnecting the motor and the output shaft, the transmission transmitting power from the motor to the output shaft to drive the output shaft in its two components of movement; and an edge guide adapted to be attached to the base for guiding the sander along an edge of the workpiece, the edge guide comprising an infeed fence and an outfeed fence, wherein the position of the infeed fence on the base is adjustable independent of the position of the outfeed fence.

18. The oscillating spindle sander of claim 17, wherein the edge guide further comprises an edge guide frame, the infeed fence and the outfeed fence each being attached to the edge guide frame, wherein the position of the infeed fence and the outfeed fence on the edge guide frame is separately adjustable and one of the infeed fence or outfeed fence can protrude away from the edge guide frame further than the other.

19. A spindle for mounting a sanding tool on an oscillating spindle sander comprising:

a spindle adapted for use with an oscillating spindle sander, the spindle having two components of movement relative to the base consisting of:

a rotation about the longitudinal axis of the output shaft;

and an oscillatory translation in a direction parallel to the longitudinal axis of the output shaft;

attachment means on one end of the spindle for attaching a fastener to hold a sanding tool on the spindle;

an increased friction portion extending at least part way around the perimeter of the spindle on an end of the spindle opposite the attachment means;

and a smooth portion between the increased friction portion and the attachment means;

the increased friction portion allowing a sanding sleeve to slide over it when the sanding sleeve is being mounted on the sanding spindle, and generating a greater frictional force per unit of area compared to the frictional force per unit of area generated by the smooth portion in response to relative rotation between the sanding sleeve and the spindle.

20. The spindle of claim 19 wherein the increased friction portion is a knurled portion whose knurled surface rises above the surface of the smooth portion.

21. A portable, hand-held oscillating spindle sander for sanding a workpiece comprising:

a base for contacting the workpiece including an closed opening formed therein;

a sanding spindle extending out from the opening in the base and capable of mounting a sanding tool, the sanding spindle having two components of movement relative to the base consisting of:

a rotation about the longitudinal axis of the sanding spindle;

and an oscillatory translation in a direction parallel to the longitudinal axis of the sanding spindle;

a motor operatively connected to the sanding spindle for driving the sanding spindle;

a transmission interconnecting the motor and the sanding spindle, the transmission transmitting power from the motor to drive the sanding spindle in its two components of movement;

a vacuum chamber formed in the base including a plurality of vacuum ports spaced around the inside of the closed opening formed in the base;

a vacuum exhaust formed on the base for connecting the vacuum chamber to an external vacuum source.

22. The portable, hand-held oscillating spindle sander of claim 21, wherein the base comprises two separate base halves which are attached together, the vacuum chamber being formed between the two separate base halves and the closed opening being formed in each of the two separate halves.

23. A portable, hand-held oscillating spindle sander for sanding a workpiece comprising:

a housing;

a base attached to the housing for contacting the workpiece and including a closed opening formed therein;

a sanding spindle extending out from the opening in the base and capable of mounting a sanding tool, the sanding spindle having two components of movement relative to the base consisting of:

a rotation about the longitudinal axis of the sanding spindle;

and an oscillatory translation in a direction parallel to the longitudinal axis of the sanding spindle;

a motor operatively connected to the sanding spindle for driving the sanding spindle;

a transmission interconnecting the motor and the sanding spindle, the transmission transmitting power from the motor to drive the sanding spindle in its two components of movement;

wherein the base is attached to the housing at a minimum of two separate support locations, a first location of support being on one side of the opening formed in the base, and a second location of support being on an opposite side of the opening.

* * * * *